US010989404B2

(12) United States Patent
Hendricks et al.

(10) Patent No.: US 10,989,404 B2
(45) Date of Patent: Apr. 27, 2021

(54) SUBMERSIBLE LIGHT

(71) Applicants: Heinz-Jakob Hendricks, Kevelaer (DE); Felix Kuepper, Xanten (DE); Jan Wessels, Goch (DE); Soeren Bleul, Duisburg (DE); Carsten Schaffarz, Neukirchen-Vluyn (DE)

(72) Inventors: Heinz-Jakob Hendricks, Kevelaer (DE); Felix Kuepper, Xanten (DE); Jan Wessels, Goch (DE); Soeren Bleul, Duisburg (DE); Carsten Schaffarz, Neukirchen-Vluyn (DE)

(73) Assignee: LED-LINEAR GMBH, Duisburg (DE)

( * ) Notice: Subject to any disclaimer, the term of this patent is extended or adjusted under 35 U.S.C. 154(b) by 0 days.

(21) Appl. No.: 16/918,351

(22) Filed: Jul. 1, 2020

(65) Prior Publication Data

US 2021/0033273 A1 Feb. 4, 2021

(30) Foreign Application Priority Data

Jul. 30, 2019 (DE) ..... 102019120525.5

(51) Int. Cl.

| | |
|---|---|
| ***F21V 31/00*** | (2006.01) |
| ***F21S 4/28*** | (2016.01) |
| ***F21V 23/00*** | (2015.01) |
| ***F21V 17/10*** | (2006.01) |
| ***F21V 31/04*** | (2006.01) |
| ***F21Y 103/10*** | (2016.01) |
| ***F21Y 115/10*** | (2016.01) |
| ***F21W 131/00*** | (2006.01) |

(52) U.S. Cl.

CPC ..... *F21V 31/005* (2013.01); *F21S 4/28* (2016.01); *F21V 17/101* (2013.01); *F21V 23/001* (2013.01); *F21V 31/04* (2013.01); *F21W 2131/00* (2013.01); *F21Y 2103/10* (2016.08); *F21Y 2115/10* (2016.08)

(58) Field of Classification Search

CPC ..... F21V 31/00; F21V 31/005; F21V 31/04; F21S 4/28

See application file for complete search history.

(56) References Cited

U.S. PATENT DOCUMENTS

| | | | | |
|---|---|---|---|---|
| 6,761,472 | B1 * | 7/2004 | Cleaver | F21S 4/20 362/219 |
| 2012/0113633 | A1 * | 5/2012 | Bowen | F21V 23/005 362/235 |
| 2013/0188358 | A1 * | 7/2013 | Wu | F21K 9/00 362/249.01 |
| 2014/0153231 | A1 * | 6/2014 | Bittmann | F21K 9/272 362/217.14 |
| 2016/0369950 | A1 * | 12/2016 | Yeager | F21V 3/02 |
| 2017/0122536 | A1 * | 5/2017 | Noga | F21K 9/20 |

* cited by examiner

*Primary Examiner* — Alan B Cariaso
(74) *Attorney, Agent, or Firm* — Andrew Wilford

(57) ABSTRACT

A submersible light has an elongated tubular inner housing extending along an axis, an LED strip carrying a plurality of light-emitting diodes fitted into and extending axially inside the inner housing, and an elongated tubular outer housing longer than the inner housing and into which the tubular inner housing fits coaxially leaving end spaces in the outer housing at axially opposite outer ends of the inner and outer housings. Respective bodies of cured potting compound sealing the end spaces at the outer ends of the inner housing.

19 Claims, 3 Drawing Sheets

A
IC
ID
IE
IF

SUBMERSIBLE LIGHT

FIELD OF THE INVENTION

The present invention relates to a submersible light and a method of making same. More particularly this invention concerns a submersible light such as is used in a swimming pool.

BACKGROUND OF THE INVENTION

A submersible light, for example for a swimming pool, is generally known in the prior art. They are frequently designed so that light bodies are integrated into an underwater recess in a wall, the recess being covered by a transparent cover that ensures waterproofing. Such structures are elaborate and prone to faults with regard to their sealing.

In the prior art LED strips have generally become established for lighting objects, in particular since they can be easily fitted into relatively long grooves. Such LED strips also exist in a splashproof design in which the strip-shaped circuit board and the LEDs mounted thereon are covered on at least one end by a potting compound. On the other hand, such strips are not suitable for use under water. LED strips that are embedded in a fundamentally watertight potting compound on all sides are not suitable for permanent use under water, in particular in chlorinated water, since the chlorine in the water can diffuse into the potting compound, can damage it and can eliminate its waterproofing capacity.

OBJECTS OF THE INVENTION

It is therefore an object of the present invention to provide an improved submersible light.

Another object is the provision of such an improved submersible light that overcomes the above-given disadvantages, in particular that has improved permanent sealing, in particular in chlorinated water, preferably such a submersible light that can be introduced into grooves in walls situated under water, for example in swimming pools.

A further object is preferably to provide such a submersible light that, after mounting for example in a groove, no longer has to be provided with further coverings. Therefore, without further additional elements, the submersible lights themselves should preferably be permanently watertight, in particular even in chlorinated water.

SUMMARY OF THE INVENTION

A submersible light has according to the invention an elongated tubular inner housing extending along an axis, an LED strip carrying a plurality of light-emitting diodes fitted into and extending axially inside the inner housing, and an elongated tubular outer housing longer than the inner housing and into which the tubular inner housing fits coaxially leaving end spaces in the outer housing at axially opposite outer ends of the inner and outer housings. Respective bodies of cured potting compound sealing the end spaces at the outer ends of the inner housing.

The method according to the invention for making such a light provides that an LED strip is inserted into an elongated tubular inner housing, with the connection lines of the LED strip projecting out of the tubular inner housing at the end. The tubular inner housing is inserted into a longer tubular outer housing with spacings between the ends of the housings and at both ends, then the spaces at both ends of the tubular outer housing are filled with a liquid curable potting compound.

Such a housing profile can be formed, for example, by a tubular profile open at both ends, for example as an extruded section or extruded profile or also cast. In principle, the cross section can have any shape, for example round, a substantially 4-cornered, i.e. quadrilateral, cross section at least of the tubular outer housing, preferably both housings, being preferred. In this case, transitions between housing walls are also understood as angular even if they are rounded.

With this configuration, enhanced permanent sealing is already obtained by arranging two housings one inside the other, since in this arrangement the tubular inner housing also remains watertight, even if the tubular outer housing develop a leak, for example due to action of force from the exterior.

With the arrangement one inside the other it may preferably be provided that a gap completely surrounding the tubular inner housing is preferably provided between the outer wall surface of the tubular inner housing and the inner wall surface of the tubular outer housing. Thus, the outer cross section of the tubular inner housing is smaller by at least the gap dimension, preferably by two times the gap dimension, than the internal cross section of the tubular outer housing. This not only enables simplified insertion of the tubular inner housing into the tubular outer housing, for example by pushing in at the end, but also forces applied to the tubular outer housing are not transmitted directly to the tubular inner housing, so the latter is protected.

The embodiment according to the invention is particularly preferred if at least the tubular outer housing, preferably both housings, is/are made from a permanently chlorine-resistant material.

This can be achieved in a preferred embodiment, for example, if at least the tubular outer housing, preferably the outer and the tubular inner housing, is/are made from polyvinyl chloride, as this material is chemically saturated with chlorine and thus cannot be penetrated by chlorine from the surrounding water, so that no chlorine-related damage to the housing material is to be expected.

The material, in particular polyvinyl chloride, of the outer and/or inner housing is preferably mixed with diffuser particles, so that the generated light is diffused by these particles. As a result, the emitted light preferably appears homogeneous over the length of the light so that the eye of the observer can no longer detect any point light sources. The light preferably emits homogeneous light over 270° around the axial direction.

Furthermore, the potting in the inner region of the tubular outer housing between each outer the end thereof and the respective outer end of the tubular inner housing preferably contributes to sealing of the tubular inner housing relative to the outer housing and of the outer housing relative to the external environment by the potting compound. Thus, the potting compound seals both housings simultaneously relative to one another and to the exterior.

The ends of the tubular outer housing and tubular inner housing are considered to be associated if the ends of both housings are close to one another, that is to say adjacent one another, in particular if they are also facing one another.

A potting compound that is chlorine-resistant is likewise preferred. More preferably, the potting compound is transparent, but in an alternative embodiment it can also have diffuser particles.

In the submersible light according to the invention, at least one open end, preferably both open ends, of the inner housing and/or at least one open end, preferably both open ends, of the outer housing is/are each provided with an end cap.

According to the inventive method the tubular inner housing is closed on both ends with inner end caps, in particular by ultrasonic welding, preferably after the LED strip has been inserted, and more preferably the connection cables of the LED strip are passed through one of these inner end caps.

Thus, in this embodiment, on at least one end, preferably both ends, of the arrangement of the inner and outer housings the end regions of the tubular outer housing between the opposing outer end caps can then be filled with the potting compound, or can be filled according to the method. The delimitation of the potting compound during filling of this region can be provided in a simple manner by the inner and outer end caps. In particular, a respective inner end cap at the end of the tubular inner housing prevents the potting compound from penetrating into the interior of the tubular inner housing during potting.

More preferably, the outer end cap(s) of the tubular outer housing and/or the inner end cap(s) of the tubular inner housing is/are made from the same material as the respective housing, that is to say for example PVC. Particularly preferably, each end cap is connected in a watertight manner to the respective housing profile by ultrasonic welding. So, a hermetically sealed fastening of the respective end caps on the respective housing profiles can be produced.

A respective end cap, preferably at least the inner cap of the inner housing, more preferably of the inner and outer housings, can more preferably likewise be made from a material, for example polyvinyl chloride (PVC), which is mixed with diffuser particles, in particular as is the case with the housings.

Due to the light diffusion thus achieved in the end regions of the inner housing, light is diffused into the potted region between the end of the inner housing and the end of the outer housing. Thus, a plurality of lights could be in a row axially, in particular abutted, without a decrease in light intensity in the transition region of the lights being perceptible to the eye of the observer.

In a preferred embodiment, the material of the inner housing and/or outer housing and/or the end caps may be pure polyvinyl chloride, except for the admixed diffuser particles.

Furthermore, according to the invention the electrical connection cables of the LED strip pass through one of the inner end caps. Thus, the connection cables in the potted region between the ends of both housings are outside the tubular inner housing and thus externally before the respective outer end cap. In particular, in this region a watertight seal is produced in this way along the entire inner extent of the connection cables, that is to say in the region of the connection cables in the tubular outer housing.

One of the inner end caps of the tubular inner housing, in particular the end cap opposite the connection end preferably has a spacer projecting toward the adjacent outer end cap of the tubular outer housing. Alternatively, the spacer can also be on the outer end cap of the outer housing and can project toward the respective inner end cap. The spacer may be, for example, a short cylindrical pin. Due to the spacer, when the tubular inner housing is pushed into the tubular outer housing the adjacent ends have a spacing that in particular corresponds at least substantially to the longitudinal length of the spacer, thus producing a defined region that can be filled with potting compound between the ends, or between the end caps.

In accordance with the inventive method the tubular inner housing with the end cap at the front, preferably with the spacer projecting outward, is inserted into the tubular outer housing, in particular after previous closure of an end of the tubular outer housing by an outer end cap.

The tubular inner housing is axially shorter than the tubular outer housing, in particular shorter than the tubular outer housing at least by the length of two spaces at the ends to be filled with potting compound.

In order to simplify the filling with potting compound, in accordance with the invention the housing wall of the tubular outer housing has at least one hole, preferably at both ends, in the region between its outer end, in particular its outer end cap and the associated outer end of the tubular inner housing, in particular its inner end cap. The filling with initially liquid potting compound can be carried out through these holes. A preferably second hole simplifies the escape of displaced air, but is not absolutely necessary.

Furthermore, the connecting cables of the LED strip pass through a hole on one the outer ends of the tubular outer housing, and in particular a cable feedthrough for these connecting cables is fastened to the hole. In this case, this may preferably be the hole through which the filling with potting compound is also carried out.

The cable guiding is preferably achieved by the above-described embodiment so that, at least in a region adjacent to the tubular outer housing, the cable outside the tubular outer housing extends perpendicular to the axial direction of the housings.

However, the invention may also provide that the connecting cables of the LED strip are guided parallel to the axis of both housings through the end caps of both housings into the outer region of the submersible light.

According to a further preferred embodiment the above-described preferably provided gap between the tubular inner housing and the tubular outer housing is closed on at least one end, preferably on both ends of the tubular inner housing by a sealing element, in particular made from an elastomer, preferably silicon. Thus, potting compound can be prevented from penetrating into the gap during filling of the region between the outer ends of both adjacent housings.

The invention can also provide that the tubular inner housing has a guide into which the LED strip can be inserted and guided, the LED strip being held by the guide close to the inner surface, preferably in contact with the inner surface of a wall of the tubular inner housing.

This wall to which the LED strip is close may also be understood as the base of the tubular inner housing, regardless of whether or not a guide is present. The opposite wall of the tubular outer housing that is close to it may be understood as the base of the tubular outer housing. The above-described respective holes for filling and/or ventilation and/or cable guiding can preferably be in the base of the tubular outer housing.

The guide can be formed, for example, by two opposing guide grooves, and each guide groove is formed by the same wall, or the base of the tubular inner housing and two projections spaced apart therefrom and pointing toward one another on walls of the tubular inner housing extending perpendicularly to this common wall.

More preferably, the circuit board of the LED strip may be fastened to a metallic support element. This can provide a sufficient thermal capacity for storage and dissipation of heat from the LED strip. The support element is preferably in contact with the wall of the tubular inner housing designated as the base.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figures 1A, 1B, 1C, 1D, 1E, 1F:
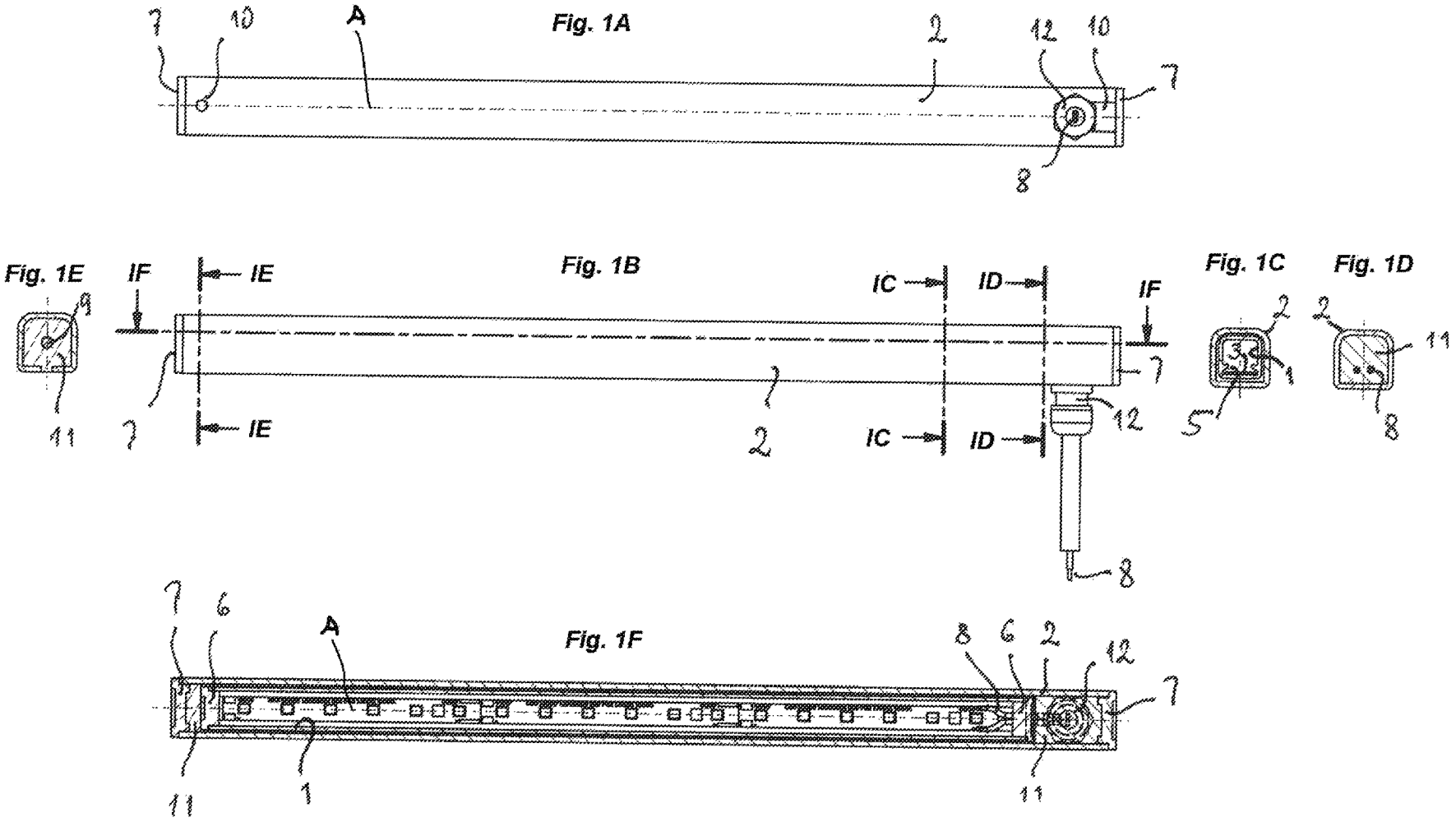
FIGS. 1A and 1B are bottom and side views of the invention.
FIGS. 1C, 1D, 1E, and 1F are cross sectional views taken along respective lines IC-IC, ID-ID, IE-IE, and IF of FIG. 1B.
Figure 2:
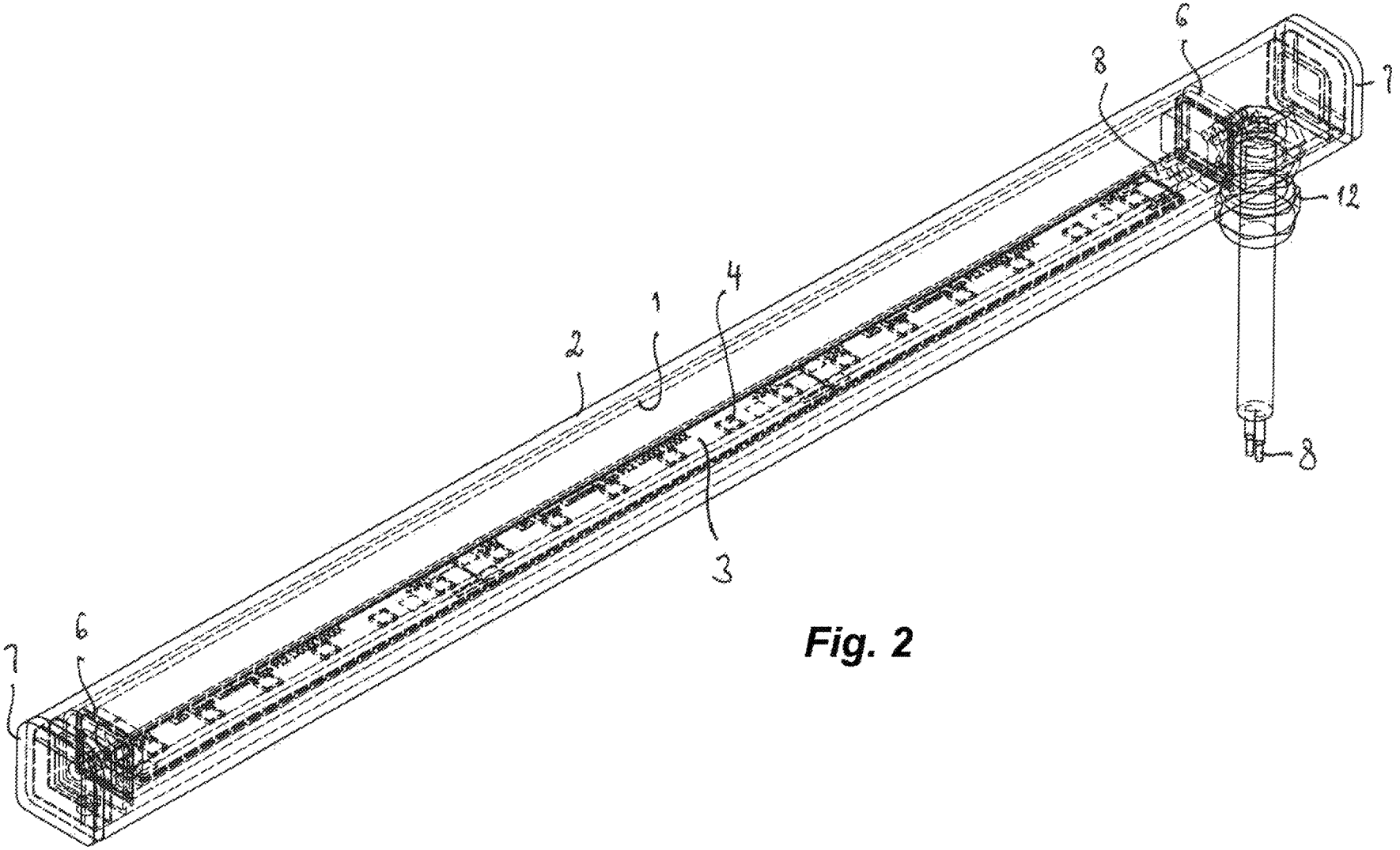
FIG. 2 is a perspective view of the invention showing internal parts in broken lines.

The drawing shows a submersible light, preferably for use in chlorinated water, with a tubular inner housing 1 and a somewhat longer tubular outer housing 2 into which is fitted the tubular inner housing 1 that is axially shorter, all centered on and extending along an axis A.

An LED strip 3 having a plurality of LEDs 4 spaced apart axially is fitted in a guide formed by the groove 5 in the inner housing 1 close to the wall thereof that is defined as the base.

Both housings 1, 2 are tubular profiles that are open at the ends and have a substantially four-cornered, i.e. quadrilateral, cross section, and whose open outer ends in the assembled light are each closed by respective inner end caps 6 and outer end caps 7.

Figure 3:
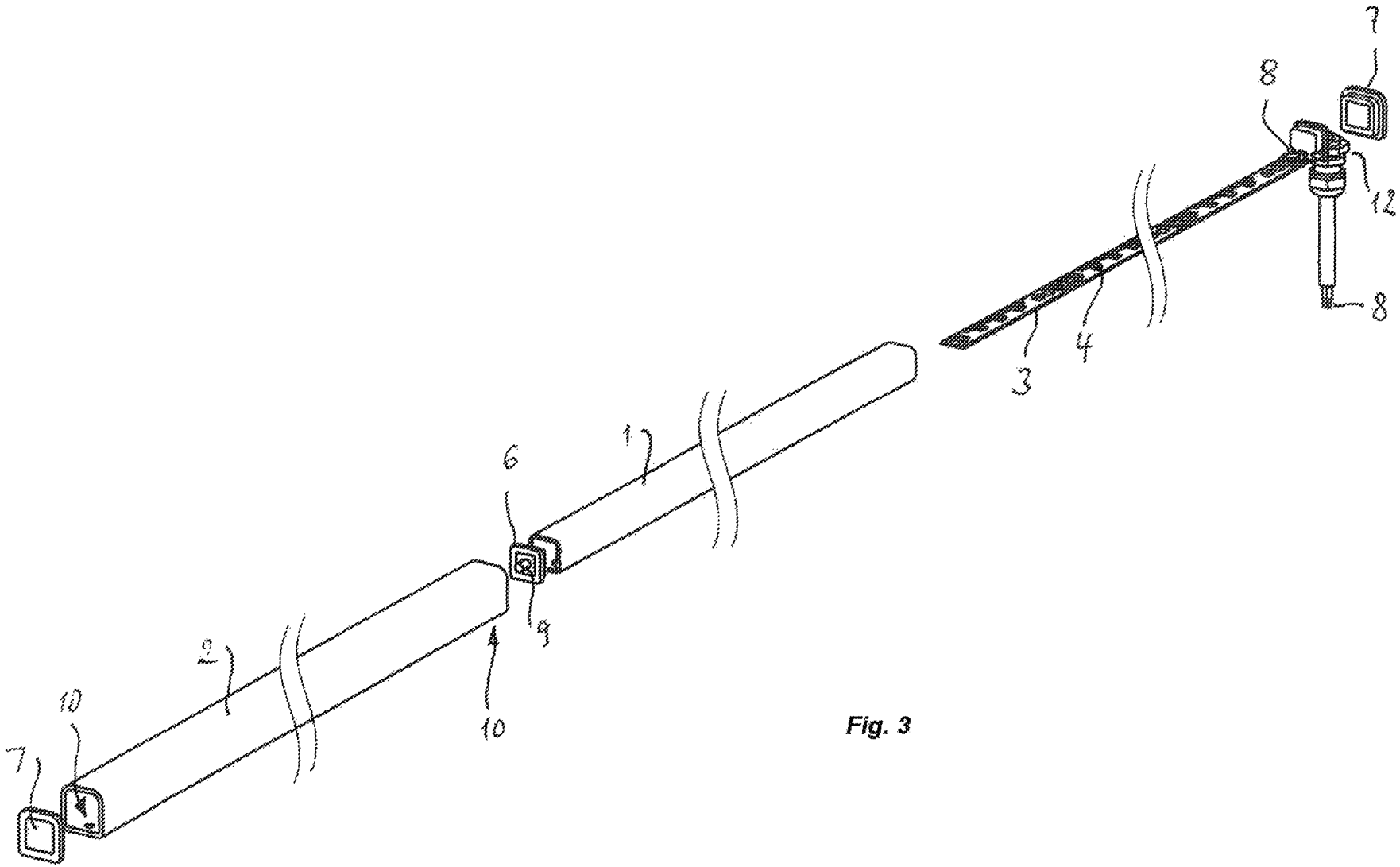
FIG. 3 is a perspective exploded view of the invention.

On the electrical connection end of the light, a connecting or power-supply cable 8 of the LED strip 3 passes through the inner end cap 6. This can be easily seen in the exploded view of FIG. 3. The connecting cable 8 extends out of the tubular outer housing 2 at an angle of 90° to the axial direction of the housings 1, 2. The wavy lines in the housings 1 and 2 and strip 3 should make it clear that these parts are not limited to the illustrated length, and in particular in each case have any length, so long as they fit into one another and the inner housing 1 is shorter than the outer housing 2.

On the end opposite the connection end, the inner end cap 6 of the tubular inner housing 1 has a pin-shaped projection 9 that points toward the respective outer end cap 7 of the adjacent tubular outer housing 2 and serves as a spacer. In this way, a spacing of defined length between these end caps 6 and 7 is kept free and, after assembly of the light, is potted with an initially liquid, curable potting compound. Such potting takes place on the connection end between the end caps 6 and 7 there.

In order to pot the light, which has been closed after assembly, between the end caps 6 and 7 on both ends, the tubular outer housing 2 has, in a region of the housing wall between the end caps 6 and 7 on each of the two ends, at least one hole 10 through which the potting compound 11 can be introduced into the inner region of the tubular outer housing 2 between the end caps 6 and 7. Air can escape either through the filling hole 10 or an additional unillustrated vent hole.

Furthermore, on the connection end a cable feedthrough 12 is mounted in the filling hole 10 but does not completely block the hole 10 there, so that filling through this hole remains possible.

We claim:

1. A submersible light comprising:

an elongated tubular inner housing extending along an axis;

an LED strip carrying a plurality of light-emitting diodes fitted into and extending axially inside the inner housing;

an elongated tubular outer housing longer than the inner housing and into which the tubular inner housing fits coaxially leaving end spaces in the outer housing at axially opposite outer ends of the inner and outer housings; and respective bodies of cured potting compound sealing the end spaces at the outer ends of the inner housing.

2. The submersible light according to claim 1, further comprising:

an inner end cap fitted with and closing one of the outer ends of the tubular inner housing; and an outer end cap fitted with and closing the respective outer end of the tubular outer housing, the body at the one outer end of the tubular inner housing completely axially filling the space between the end caps.

3. The submersible light according to claim 2, further comprising:

another inner end cap fitted with and closing the other outer end of the inner housing; and another outer end cap fitted with and closing the other outer end of the outer housing, the bodies in both of the end spaces axially filling the spaces between each of the inner end caps and the respective outer end cap.

4. The submersible light according to claim 2, further comprising:

an electrical power supply cable extending through the end cap and the respective body to the LED strip in the tubular inner housing.

5. The submersible light according to claim 2, wherein the inner end cap has a spacer extending coaxially into the tubular outer housing from the inner end cap and engaging and spacing the outer end cap.

6. The submersible light according to claim 2, wherein the tubular outer housing is formed adjacent the one outer end with a radially throughgoing hole, whereby the body can be injected into the end space at the one outer end through the hole.

7. The submersible light according to claim 6, further comprising:

an electrical power supply cable extending through the hole and the body at the one outer end and between the inner end cap and the respective outer end of the tubular inner housing to the LED strip inside the tubular inner housing.

8. The submersible light according to claim 1, further comprising:

an elastomeric seal radially between the tubular inner housing and the tubular outer housing.

9. The submersible light according to claim 1 wherein the outer housing is made from polyvinyl chloride.

10. The submersible light according to claim 9, further comprising:

a end cap of polyvinyl chloride fitted with and closing one of the outer ends of the outer housing, the respective body in the end space adjacent the cap filling the space completely between the respective inner end cap on the outer end of the inner housing and the outer end cap; and an ultrasonic weld fixing the end cap to the tubular outer housing.

11. The submersible light according to claim 1, wherein the tubular inner housing is formed with an axially extending guide into which is fitted the LED strip.

12. The submersible light according to claim 11, wherein the guide is formed as two diametrally opposite and inwardly open guide grooves.

13. The submersible light according to claim 1, wherein the LED strip has a metallic base strip.

14. A method of making a submersible light comprising the steps of:

inserting an LED strip axially into an axially elongated tubular inner housing with an electrical connection line of the LED strip projecting out of one outer end of the tubular inner housing;

inserting the tubular inner housing holding the LED strip into an axially longer long tubular housing leaving a space between each outer end of the tubular inner housing and the respective outer end of the tubular outer housing; and potting the spaces at both ends of the tubular inner housing with a fluent but curable potting compound.

15. The method according to claim 14, further comprising the step of:

fitting both outer ends of the tubular inner housing with inner end caps;

welding the inner end caps to the tubular inner housing; and passing the electrical connection line through the inner end cap at one of the outer ends of the tubular inner housing.

16. The method according to claim 14, wherein at least one of the end caps is provided with an axial projection, the method further comprising the step of:

positioning the inner housing axially in the tubular outer housing using the spacer, whereby the respective space has a predetermined axial dimension.

17. The method according to claim 14, further comprising the step of:

fitting both outer ends of the tubular outer housing with outer end caps;

welding the outer end caps to the tubular outer housing.

18. The method according to claim 17, providing the tubular outer housing at both outer ends between the respective inner and outer end caps with a radially throughgoing hole, the potting being injected into the spaces through the holes.

19. The method according to claim 17, further comprising the step of:

passing an electrical feed cable from the LED strip through the body at one of the outer ends then through the hole at the space between one of the outer ends of the tubular inner housing and the respective outer end of the tubular outer housing.

* * * * *